US012589326B2

(12) United States Patent
Morooka et al.

(10) Patent No.: US 12,589,326 B2
(45) Date of Patent: Mar. 31, 2026

(54) PARTS SUPPLY BODY

(71) Applicant: BANDAI CO., LTD., Tokyo (JP)

(72) Inventors: Yusuke Morooka, Tokyo (JP); Erika Nagai, Tokyo (JP)

(73) Assignee: BANDAI CO., LTD., Tokyo (JP)

( * ) Notice: Subject to any disclaimer, the term of this patent is extended or adjusted under 35 U.S.C. 154(b) by 249 days.

(21) Appl. No.: 18/554,255

(22) PCT Filed: Apr. 11, 2022

(86) PCT No.: PCT/JP2022/017451

§ 371 (c)(1),
(2) Date: Oct. 6, 2023

(87) PCT Pub. No.: WO2022/220206

PCT Pub. Date: Oct. 20, 2022

(65) Prior Publication Data

US 2024/0189732 A1 Jun. 13, 2024

(30) Foreign Application Priority Data

Apr. 14, 2021 (JP) ..... 2021-068512

(51) Int. Cl.
*A63H 3/16* (2006.01)
*A63H 9/00* (2006.01)
(Continued)

(52) U.S. Cl.
CPC ..... *A63H 33/42* (2013.01); *A63H 3/16* (2013.01); *A63H 9/00* (2013.01)

(58) Field of Classification Search
CPC . A63H 3/16; A63H 9/00; A63H 33/04; A63H 33/42; B29C 45/0062;
(Continued)

(56) References Cited

U.S. PATENT DOCUMENTS 6,475,054 B1 * 11/2002 Liu ..... A63H 3/10 446/474
6,626,732 B1 * 9/2003 Chung ..... A63H 3/16 446/268
(Continued)

FOREIGN PATENT DOCUMENTS

JP 2010228137 A 10/2010
JP 2012061110 A 3/2012
(Continued)

OTHER PUBLICATIONS

International Search Report for PCT/JP2022/017451, mailed on Jun. 28, 2022.
Written Opinion for PCT/JP2022/017451, mailed on Jun. 28, 2022.

*Primary Examiner* — John A Ricci
(74) *Attorney, Agent, or Firm* — Rabin & Berdo, P.C.

(57) ABSTRACT

A parts supply body includes a plurality of parts supply units including parts of a model, the parts supply units being connected to each other. Each of the parts supply units is structured such that only at least one or more parts belonging to one portion among a plurality of portions that constitute the model are each connected to a first runner by a second runner. The first runners of the parts supply units are connected to each other such that the parts supply units are separable from each other. Each parts supply unit includes first identification information and second identification information, the first identification information indicating one of the portions that corresponds to the parts supply unit, the second identification information being used to uniquely distinguish the parts supply body from another one or more parts supply bodies including other parts of the model.

12 Claims, 3 Drawing Sheets

(51) Int. Cl.
*A63H 33/42* (2006.01)
*B29C 45/00* (2006.01)

(58) Field of Classification Search
CPC ..... B29C 45/0081; B29C 2045/2683; B29C 2045/2691; B29C 45/26; B29C 2045/2695
See application file for complete search history.

(56) References Cited

U.S. PATENT DOCUMENTS

| | | | | |
|---|---|---|---|---|
| 9,227,145 | B2 * | 1/2016 | Chang | A63H 3/10 |
| 9,610,512 | B2 * | 4/2017 | Bae | A63H 33/086 |
| 11,565,191 | B2 * | 1/2023 | Williams | A63H 9/00 |

FOREIGN PATENT DOCUMENTS

| | | | |
|---|---|---|---|
| JP | 2012061696 | A | 3/2012 |
| JP | 2016202635 | A | 12/2016 |

* cited by examiner

PARTS SUPPLY BODY

TECHNICAL FIELD

The present invention relates to a parts supply body.

BACKGROUND ART

A known parts supply body includes branched runners connecting a plurality of parts to be assembled into portions that constitute an assembly model (PTL 1). The parts supply body described in PTL 1 is structured such that the runners are easily dividable into small pieces that are easy to dispose of.

CITATION LIST

Patent Literature

PTL 1: Japanese Unexamined Patent Application Publication No. 2010-228137

SUMMARY OF INVENTION

Technical Problem

An assembly model is generally assembled by individually assembling portions, such as a head portion, a torso portion, arm portions, and leg portions, that constitute the assembly model from parts belonging to each portion. In such a case, parts supply units including groups of parts belonging to the respective portions are preferably separable from each other. However, in the above-described parts supply body, the runners are dividable irrespective of the groups of parts belonging to the respective portions that constitute the assembly model. Therefore, a user needs to know which part belongs to which portion when dividing the runners, and the assembly efficiency cannot be increased. Even when the groups of parts belonging to the respective portions are separable from each other, it is difficult to immediately recognize which group of parts corresponds to which portion.

The present invention provides a parts supply body including parts supply units which each include parts belonging to the same portion, the parts supply units being separable from each other such that it is easy to recognize which part supply unit corresponds to which portion after the separation.

Solution to Problem

To solve the above-described problems, a parts supply body according to the invention includes a plurality of parts supply units including parts of a model, the parts supply units being connected to each other. Each of the parts supply units is structured such that only at least one or more parts belonging to one portion among a plurality of portions that constitute the model are each connected to a first runner by a second runner. The first runners of the parts supply units are connected to each other such that the parts supply units are separable from each other. Each parts supply unit includes first identification information and second identification information, the first identification information indicating one of the portions that corresponds to the parts supply unit, the second identification information being used to uniquely distinguish the parts supply body from another one or more parts supply bodies including other parts of the model.

Advantageous Effects of Invention

According to the present invention, a parts supply body can be configured to include parts supply units which each include parts belonging to the same portion, the parts supply units being separable from each other such that it is easy to recognize which part supply unit corresponds to which portion after the separation.

DESCRIPTION OF EMBODIMENTS

Figure 1:
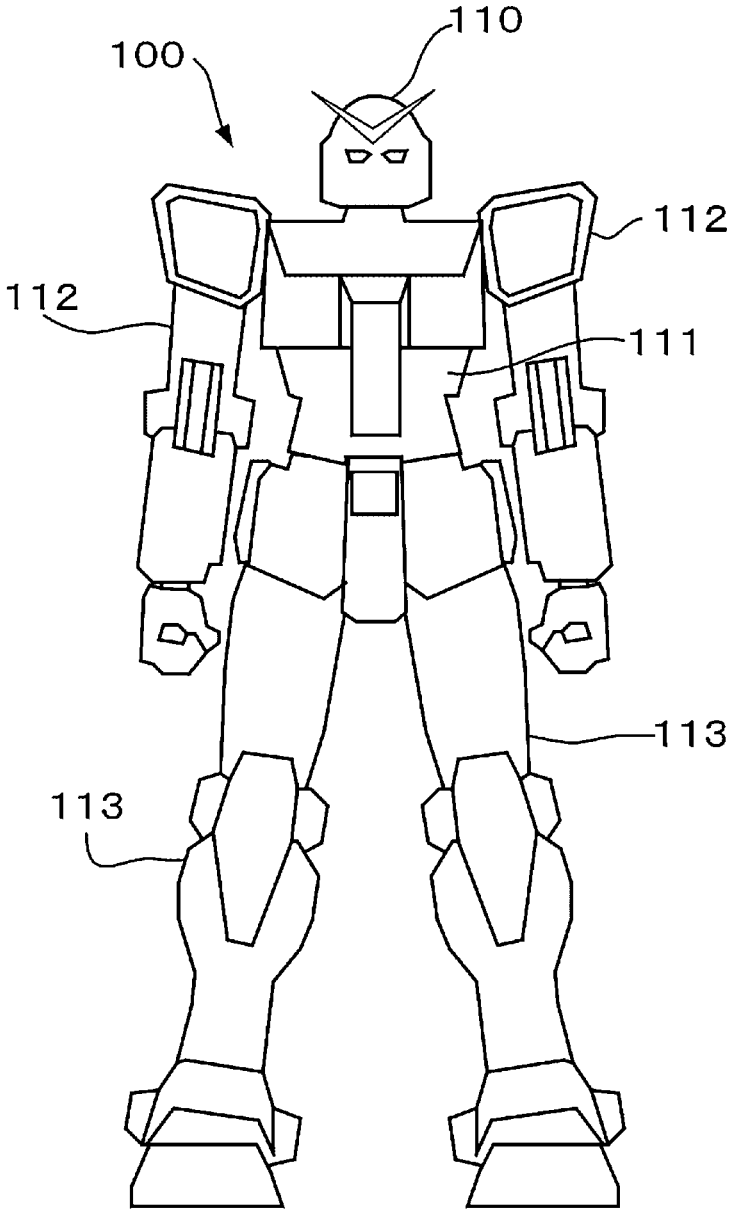
FIG. 1 illustrates an example of the structure of a figure toy created by assembling parts included in parts supply bodies according to an embodiment.

An embodiment will now be described in detail with reference to the accompanying drawings. The embodiment described below does not limit the invention described in the claims, and combinations of features described in the embodiment are not necessarily essential to the invention. Any two or more of the features described in the embodiment may be combined. The same or similar components are denoted by the same reference numerals, and redundant description is omitted.

FIG. 1 illustrates an example of the appearance of a figure toy according to the present embodiment. FIG. 1 is a schematic diagram illustrating a simplified appearance of a figure toy 100 according to the embodiment. The figure toy 100 includes model components including a head portion 110, a torso portion 111, arm portions 112, and leg portions 113, and is formed by joining these portions together. At least one of the portions 110 to 113 is rotatably (or swingably) supported relative to a portion adjacent thereto. For example, the head portion 110 is supported such that the head portion 110 is rotatable relative to the torso portion 111, and the arm portions 112 are supported such that the arm portions 112 are rotatable and tiltable forward and backward relative to the torso portion 111. The leg portions 113 are supported such that the leg portions 113 are rotatable relative to the torso portion 111. Each leg portion 113 has a knee joint and is bendable by rotating sections above and below the knee rotate. Thus, the portions of the figure toy 100 have joint structures that enable a user (for example, the owner of the figure toy 1) to pose the figure toy 100 in a desired position. Although not illustrated in FIG. 1, one or more decorative components may be attached to the figure toy 100. The decorative components may be formed similarly to the model components of the figure toy described in the present embodiment. The decorative components may be, for example, a weapon, such as a sword or a gun, and a protective device, such as a shield.

In this specification, terms such as front (forward) back (backward), left (leftward), right (rightward), up (upward), and down (downward) may be used to describe the positional relationships between the portions. These terms are used in relation to the figure toy 1 as a reference. For example, "front" means front with respect to the figure toy 100, and "back" means back with respect to the figure toy 100.

In the present embodiment, the model components that constitute the figure toy 100 may be made of a thermoplastic resin, such as ABS. Materials other than ABS (for example, polyethylene, polystyrene, and thermosetting resin) may also be used. Alternatively, each model component may be composed of an inner part made of ABS or the like and an outer part made of a metal material that externally covers the inner part.

Figure 2:
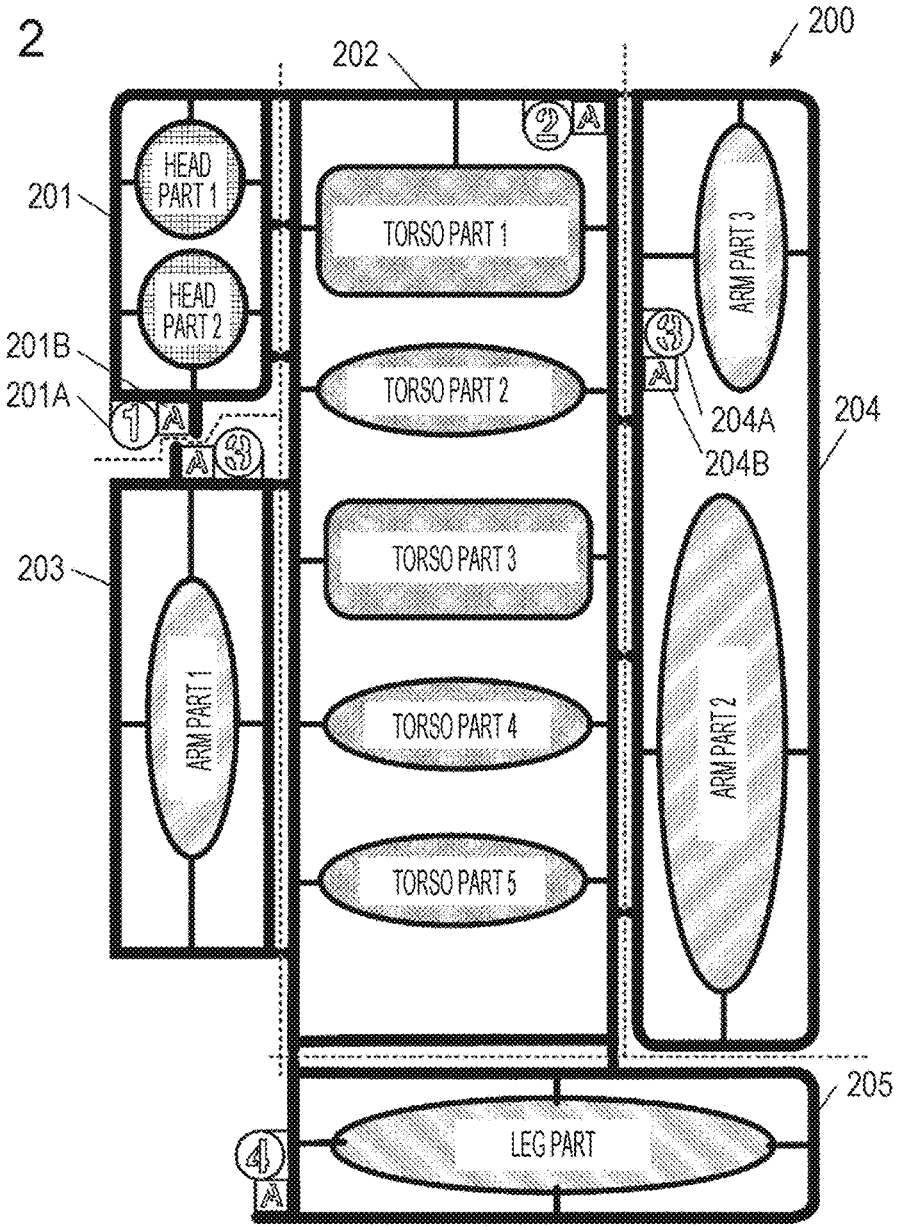
FIG. 2 is a plan view illustrating an example of the structure of a parts supply body according to the embodiment.

An example of the structure of a parts supply body 200 according to the embodiment will be described with reference to FIG. 2. The parts supply body 200 supplies parts to be assembled into portions that constitute the figure toy 100, which is an assembly model. These portions include the head portion 110, the torso portion 111, the arm portions 112, and the leg portions 113. The portions that constitute the figure toy 100 may be further divided into smaller portions, and may additionally include, for example, a protective device and a weapon. The parts supply body 200 includes a head parts supply unit 201, torso parts 202, arm parts supply units 203 and 204, and a leg parts supply unit 205. As illustrated in FIG. 2, the parts supply units for the head portion, the torso portion, the arm portions, and the leg portions may be arranged in that order from the top so that the arrangement thereof corresponds to the arrangement of the portions of the figure toy 100. When the arrangement of the parts supply units corresponds to the arrangement of the portions of the figure toy 100, the user can intuitively recognize which parts supply unit corresponds to which portion. It is not necessary that the arrangement of the parts supply units strictly correspond to the arrangement of the portions as long as the arrangements roughly correspond. For example, the head parts supply unit is preferably disposed in an upper region of the parts supply body. Similarly, the leg parts supply unit is preferably disposed in a lower region of the parts supply body. It is not necessary that the head parts supply unit be disposed between the arm parts supply units or above the torso parts supply unit.

Each parts supply unit includes main runners (first runners), auxiliary runners (second runners), and parts. The parts are connected to the main runners by the auxiliary runners, and the auxiliary runners have a cross-sectional diameter smaller than that of the main runners. The parts supply units are connected to each other by connecting members provided between the main runners. The connecting members have a cross-sectional diameter smaller than that of the main runners and greater than that of the auxiliary runners. The parts supply units can be separated from each other by, for example, breaking the connecting members between the main runners. Thus, the parts supply units can be separated from each other. In FIG. 2, the parts supply units disposed in sections partitioned from each other along the dotted lines are separable from each other.

Each parts supply unit is provided with a first tag displaying first identification information indicating the portion (for example, the head portion or the torso portion) to be formed by assembling the parts included in the parts supply unit. For example, the head parts supply unit 201 is provided with a first tag 201A. This similarly applies to the other parts supply units. Therefore, even after the parts supply units are separated from each other, it is easy to determine which parts supply unit corresponds to which portion. The first identification information may be, for example, a character (a hiragana character, a kanji character, a number, an alphabet, or a sign), or a graphic symbol. The first identification information on the first tag 201A is in the form of a cutout having an outline of a character (blank character). Therefore, the first identification information is recognizable from both the front side and the back side of the parts supply body 200. In the present embodiment, the concept of "blank character" includes a cutout having an outline of a graphic symbol.

When the parts of the figure toy 100 are included in a plurality of parts supply bodies, each parts supply body is additionally provided with second tags displaying second identification information for uniquely distinguishing the parts supply body from the other parts supply bodies. For example, the head parts supply unit 201 is provided with a second tag 201B. This similarly applies to the other parts supply units. Due to the second identification information, even after the parts supply units are separated from each other, it is easy to determine which parts supply unit is separated from which parts supply body 200. The second identification information on the second tag 201B is in the form of a cutout having an outline of a character (blank character). Therefore, the second identification information is recognizable from both the front side and the back side of the parts supply body 200. The concept of the blank character is similar to that for the first identification information.

The second identification information may be, for example, a character (a hiragana character, a kanji character, a number, an alphabet, or a sign), or a graphic symbol, and may be identification information of a type be different from the type of the first identification information. For example, when the first identification information is a number, the second identification information may be an alphabet or a kanji character representing the corresponding portion.

In FIG. 2, the first identification information is "1" for the "head portion", "2" for the torso portion, "3" for the arm portions, and "4" for the "leg portions". The second identification information is "A", which indicates that the parts supply body 200 is the first one of a plurality of parts supply bodies 200. In the present embodiment, the first identification information and the second identification information are arranged adjacent to each other. This provides increased visibility and strength. In the present embodiment, the combination of the first identification information and the second identification information allows unique identification of each parts supply unit even after the parts supply unit is separated from the parts supply body. This is advantageous in, for example, specifying parts supply units and parts in an assembly manual.

In the present embodiment, each first tag and the corresponding second tag are formed integrally with each other in a rectangular region projecting from a main runner and having a predetermined thickness. The predetermined thickness may be less than the diameter of the main runner, or equivalent to the diameter of the main runner. The first tag may include a portion having a circular outline and projecting in a region inside the outline. The size of the first identification information is greater than the size of the second identification information. The first identification information and the second identification information can be easily distinguished from each other based on the presence or absence of the projecting portion and the sizes of the first and second identification information.

The method for visually distinguishing the first tag and the second tag from each other is not limited to the above-described method. For example, the second tag displaying the second identification information may include a projecting portion. Alternatively, the first tag may include a recessed portion, or the second tag may include a recessed portion. Also, the relationship between the sizes of the first tag and the second tag may be reversed so that the size of the second identification information is greater than the size of the first identification information.

The first tag and the second tag may be positioned to project outward from a main runner constituting an outer frame of the corresponding parts supply unit. In such a case, to prevent breakage of the tags, the second tag may be connected to another main runner that is orthogonal to the main runner on which the first tag is formed. In this case, the second tag having a rectangular shape is formed such that two adjacent sides thereof are connected to the respective main runners, and the other main runner has a height corresponding to the height or width of the second tag. For example, the second tag 201B has the main runners on the upper and right sides thereof, and thus the two adjacent sides are connected to the main runners. The main runner on the upper side of the second tag 201B extends beyond the first tag and the second tag. However, the main runner on the right side of the second tag 201B extends only by a distance corresponding to the height of the second tag 201B. According to this structure, the tag section has a greater strength and do not easily break.

Alternatively, similarly to a second tag 204B on the parts supply unit 204, the second tag may be positioned to project inward from a main runner constituting an outer frame of the parts supply unit. In such a case, the second tag 204B may be connected to the main runner on which the first tag 204A is formed only at one side thereof.

Figure 3:
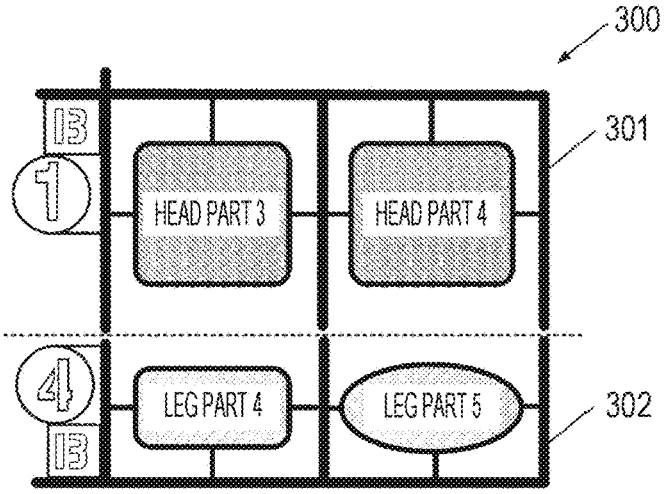
FIG. 3 illustrates an example of the structure of another parts supply body according to the embodiment.

FIG. 3 illustrates the structure of a parts supply body 300 that differs from the parts supply body 200. In this structure, a head parts supply unit 301 whose first identification information is "1" and a leg parts supply unit 302 whose first identification information is "4" are connected to each other in a separable manner. The second identification information is "B", and the parts supply body 300 is a parts supply body different from the parts supply body 200 illustrated in FIG. 2. Even when, for example, the leg parts supply unit 302 is separated, the leg parts supply unit 302 can be easily recognized as belonging to the parts supply body 300 based on the second identification information. In FIG. 3, no main runners orthogonal to connecting members are provided between the parts supply unit 301 and the parts supply unit 302. Thus, the structure differs from the structure illustrated in FIG. 2 in which the connecting members are provided on the main runners orthogonal to the connecting members.

Figure 4:
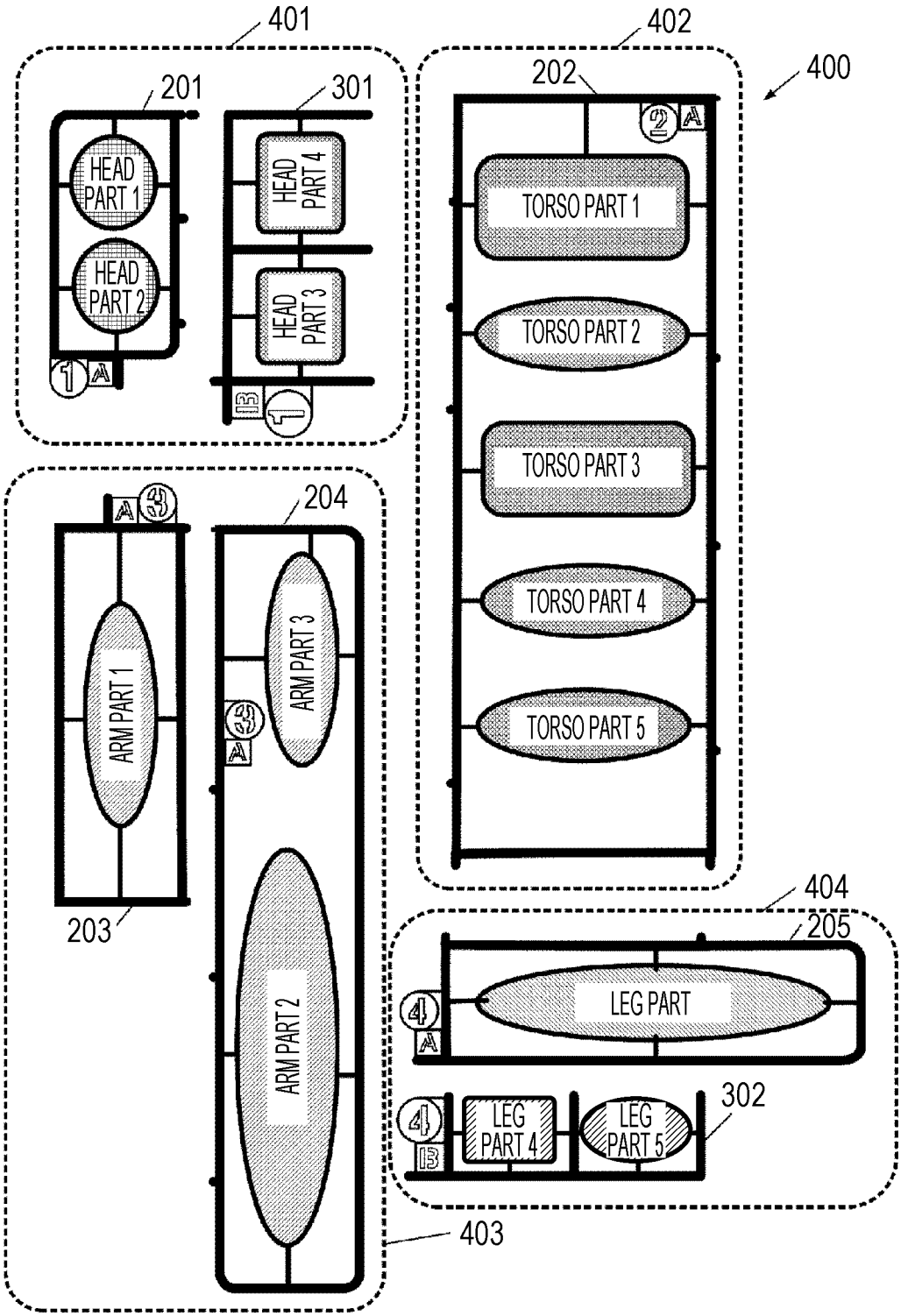
FIG. 4 illustrates parts supply units separated from each other by dividing each of the parts supply bodies according to the embodiment and grouped ingo groups corresponding to respective portions.

FIG. 4 illustrates parts supply units separated from the parts supply bodies 201 and 301 illustrated in FIGS. 2 and 3 and grouped into groups corresponding to respective portions. A dotted line 401 surrounds the parts supply units 201 and 301 including the head parts. Similarly, dotted lines 402, 403, and 404 surround parts supply units 202 to 205 and 302 including parts of the torso portion, the arm portions, and the leg portions, respectively. As illustrated in FIG. 4, even when the parts supply units are separated from each other, it is easy to determine which parts supply unit corresponds to which portion and which parts supply unit belongs to which parts supply body based on the first identification information and the second identification information.

Although the embodiment of the invention has been described in detail, the parts supply body is not limited to the above-described embodiment, and various modifications and alterations are possible within the scope of the present invention described in the claims. Although the parts supply bodies 200 and 300 used to assemble the figure toy 100 as an assembly model are described above in the embodiment, the assembly model is not limited to this, and may be other types of assembly models including a plurality of portions.

The invention claimed is:

1. A parts supply body for a model, which is constituted by a plurality of first portions and at least one second portion, the second portion being provided by another parts supply body, comprising:

a plurality of parts supply units including a plurality of parts for the plurality of first portions, each first portion including at least one of the parts, wherein each of the plurality of parts supply units corresponds to one of the plurality of first portions, and is structured to include a subset of the at lease one part belonging to said one first portion, each part in said subset being connected to a first runner by a second runner, wherein the first runners of the plurality of parts supply units are connected to such that the plurality of parts supply units are separably connected to one another, and wherein each of the plurality of parts supply units includes:

first identification information indicating one of the plurality of first portions that corresponds to said each parts supply unit, and second identification information being used to uniquely distinguishing the parts supply body from the another parts supply body, the second identification information being configured to be visually distinguishable from the first identification information.

2. The parts supply body according to claim 1, wherein each of the plurality of parts supply units includes:

a first tag displaying the first identification information, and a second tag displaying the second identification information, wherein the first tag and the second tag are formed integrally with each other and connected to one of the first runners in said each parts supply unit.

3. The parts supply body according to claim 2, wherein the second tag is connected to another of the first runners in said each parts supply unit, said another first runner being orthogonal to the first runner on which the first tag is formed.

4. The parts supply body according to claim 3, wherein said another first runner has a length corresponding to a height or a width of the second tag.

5. The parts supply body according to claim 2, wherein the first tag includes a projecting portion or a recessed portion, and the first identification information is in a form of a cutout formed in the projection portion or the recessed portion.

6. The parts supply body according to claim 2, wherein the second tag includes a projecting portion or a recessed portion, and the second identification information is in a form of a cutout formed in the projection portion or the recessed portion.

7. The parts supply body according to claim 1, wherein each of the first identification information and the second identification information is in a form of a cutout.

8. The parts supply body according to claim 1, wherein the first identification information and the second identification information are different types of identification information selected from characters including a hiragana character, a kanji character, a number, an alphabet, and a sign and a graphic symbol.

9. The parts supply body according to claim 1, wherein the first identification information and the second identification information have different sizes.

10. The parts supply body according to claim 9, wherein the second identification information has a smaller size than the first identification information.

11. The parts supply body according to claim 1, wherein the first and second portions that constitute the model include a head portion, a torso portion, an arm portion, and a leg portion of the model.

12. The parts supply body according to claim 11, wherein an arrangement of the parts supply units in the parts supply body corresponds to an arrangement of the portions corresponding to the parts supply units in the model.

* * * * *